US005204232A

United States Patent [19]

Sato et al.

[11] Patent Number: 5,204,232

[45] Date of Patent: Apr. 20, 1993

[54] PHOTOGRAPHIC MATERIAL WITH FLUORESCENCE COMPOUND RELEASER

[75] Inventors: Hirokazu Sato; Shigeo Tanaka; Satoru Ikesu, all of Hino, Japan

[73] Assignee: Konica Corporation, Tokyo, Japan

[21] Appl. No.: 666,914

[22] Filed: Mar. 11, 1991

[30] Foreign Application Priority Data

Mar. 15, 1990 [JP] Japan ..... 2-65830

[51] Int. Cl.[5] ..... G03C 7/26; G03C 7/32; G03C 7/18

[52] U.S. Cl. ..... 430/512; 430/139; 430/223; 430/226; 430/359; 430/543; 430/549; 430/517; 430/522; 430/553; 430/555; 430/557; 430/558; 430/955; 430/958; 430/933

[58] Field of Search ..... 430/439, 223, 226, 359, 430/543, 549, 512, 517, 558 R, 558 A, 955, 958, 933, 522, 557, 553, 555

[56] References Cited

U.S. PATENT DOCUMENTS 3,617,291 11/1971 Sawdey ..... 430/555
4,774,181 9/1988 Ravindran et al. ..... 430/359
4,942,114 7/1990 Shiba et al. ..... 430/359

FOREIGN PATENT DOCUMENTS 286331 10/1988 European Pat. Off.

*Primary Examiner*—Richard L. Schilling
*Attorney, Agent, or Firm*—Finnegan, Henderson, Farabow, Garrett & Dunner

[57] ABSTRACT

Disclosed is a light-sensitive silver halide photographic material having at least one silver halide emulsion layer on a support, characterized in that at least one layer of the above silver halide emulsion layers contains a compound represented by the following formula (I):

(I)

wherein n represents 0 or 1; A represents a compound residue which cleaves a bonding to Time in the case of n=1 or a compound residue which cleaves one of bondings to FL in the case of n=0; Time represents a timing group which cleaves a bonding to FL after cleavage from A; and FL represents a compound residue which emits fluorescence by cleavage of a bonding to Time in the case of n=1 and a compound residue which emits fluorescence by cleavage of one of bondings to A in the case of n=0.

9 Claims, No Drawings

PHOTOGRAPHIC MATERIAL WITH FLUORESCENCE COMPOUND RELEASER

BACKGROUND OF THE INVENTION

This invention relates to a light-sensitive silver halide photographic material, more specifically to a light-sensitive silver halide photographic material containing a compound which emits fluorescence imagewisely.

As a technique for correcting spectral absorption of dye images formed by couplers, an image-forming element containing a coupler which releases a fluorescent dye has been disclosed in U.S. Pat. No. 4,774,181. In this technique, a fluorescent dye is released imagewisely from a coupler by color development, whereby unncessary absorption of an image dye formed is corrected optically.

However, when this coupler which releases a fluorescent dye is used, most of fluorescent dyes released are flown out from photographic constituent layers during development processing, whereby a sufficient effect cannot be obtained. Further, there involves a problem that aging stability of an optical correction effect of unnecessary absorption by a fluorescent dye is not sufficient. Furthermore, in this technique, a mordant is used for the purpose of preventing said outflow of fluorescent dyes from photographic constituent layers. However, it has been clarified that in this case, stain due to sensitizing dyes and water-soluble dyes is increased, and therefore, a product cannot be put to practical use.

SUMMARY OF THE INVENTION

The present invention has been accomplished in consideration of the above situation, and an object of the present invention is to provide a light-sensitive silver halide photographic material in which optical correction of unnecessary absorption of a dye image can be effectively carried out by a fluorescent dye, its stability with a lapse of time is excellent and yet stain is prevented.

The above object of the present invention can be accomplished by a light-sensitive silver halide photographic material having at least one silver halide emulsion layer on a support, characterized in that at least one layer of the above silver halide emulsion layers contains a compound represented by the following formula (I):

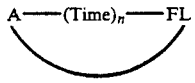

(I)

wherein n represents 0 or 1; A represents a compound residue which cleaves a bonding to Time in the case of n=1 or a compound residue which cleaves one of bondings to FL in the case of n=0; Time represents a timing group which cleaves a bonding to FL after cleavage from A; and FL represents a compound residue which emits fluorescence by cleavage of a bonding to Time in the case of n=1 and a compound residue which emits fluorescence by cleavage of one of bondings to A in the case of n=0.

DESCRIPTION OF THE PREFERRED EMBODIMENTS

In the following, the present invention is explained in detail.

In the above formula (I), a group represented by A represents a group which cleaves —(Time)$_n$— by reacting with an oxidized product of a developing agent, which may be a coupler residue which cleaves —(Time)$_n$— by a coupling reaction or a group which cleaves —(Time)$_n$— through a redox reaction with an oxidized product of a developing agent.

When A is a coupler residue, A may be a yellow coupler residue, a magenta coupler residue, a cyan coupler residue or a coupler residue substantially not forming an image dye (a colorless coupler residue), preferably a coupler residue represented by the following formulae (Ia) to (Ih).

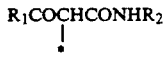

(Ia)

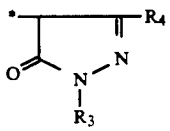

(Ib)

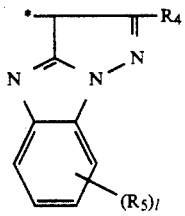

(Ic)

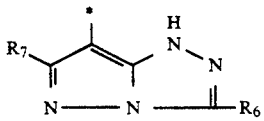

(Id)

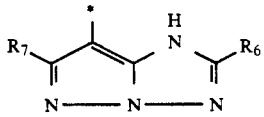

(Ie)

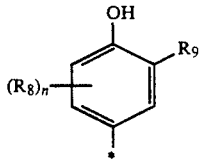

(If)

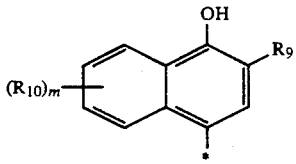

(Ig)

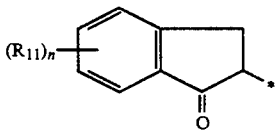

(Ih)

In the above formula (Ia), $R_1$ represents an alkyl group, an aryl group or an arylamino group, and $R_2$ represents an aryl group or an alkyl group.

In the above formula (Ib), $R_3$ represents an alkyl group or an aryl group, and $R_4$ represents an alkyl group, an acylamino group, an arylamino group, an arylureido group or an alkylureido group.

In the above formula (Ic), $R_4$ has the same meaning as $R_4$ in the formula (Ib), and $R_5$ represents an acylamino group, a sulfonamide group, an alkyl group, an alkoxy group or a halogen atom.

In the above formulae (Id) and (Ie), $R_6$ represents an alkyl group or an aryl group, and $R_7$ represents an alkyl group, an aryl group, an acylamino group, an arylamino group, an alkoxy group, an arylureido group or an alkylureido group.

In the above formula (If), $R_8$ represents a halogen atom, an alkyl group, an alkoxy group, an acylamino group or a sulfonamide group, and $R_9$ represents an acylamino group, a carbamoyl group or an arylureido group.

In the above formula (Ig), $R_9$ has the same meaning as $R_9$ in the formula (If), and $R_{10}$ represents an amino group, a substituted amino group, an amide group, a sulfonamide group or a hydroxyl group.

In the above formula (Ih), $R_{11}$ represents a nitro group, an acylamino group, a succinimide group, a sulfonamide group, an alkoxy group, an alkyl group, a halogen atom or a cyano group.

In the above formulae, "*" represents a bonding position to $-(Time)_n-$. l in (Ic) represents an integer of 0 to 3, n in (If) and (Ih) 0 to 2, and m in (Ig) 0 or 1, respectively. When l and n are 2 or more, each $R_5$, $R_8$ and $R_{11}$ may be the same or different from each other.

The above respective groups may include those having a substituent, and as a preferred substituent, there may be mentioned a halogen atom, a nitro group, a cyano group, a sulfonamide group, a hydroxyl group, a carboxyl group, a substituted or unsubstituted alkyl group, a substituted or unsubstituted alkoxy group, a carbonyloxy group, an acylamino group, a substituted or unsubstituted aryl group, and also groups containing a coupler portion constituting the so-called bis type coupler and polymer coupler.

Either one of $R_1$ or $R_2$ in (Ia), $R_3$ or $R_4$ in (Ib), $R_4$ or $R_5$ in (Ic), $R_6$ or $R_7$ in (Id), $R_6$ or $R_7$ in (Ie), $R_8$ or $R_9$ in (If), $R_9$ or $R_{10}$ in (Ig) and $R_{11}$ in (Ih) is necessarily bonded to an FL portion.

When A is a group which cleaves $-(Time)_n-$ through redox reaction with an oxidized product of a color developing agent, A is preferably represented by the following formulae.

$$ED^1-* \quad \text{(IIa)}$$

$$ED^2-(L)_m-A_1-* \quad \text{(IIb)}$$

$$R-X-A_1-\underset{\underset{R_1}{|}}{NH}-N-\underset{\underset{*}{|}}{CH_2}CH-B \quad \text{(IIc)}$$

(IId)

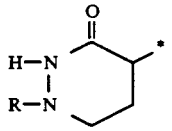

In the formula (IIa), $ED^1$ represents a redox mother nucleus obeying Kendall-Pelz Law, and can cleave $-(Time)_n-$ by being oxidized by an oxidized product of a developing agent during photographic development processing.

$ED^1$ is described in more detail. As a redox mother nucleus represented by $ED^1$, there may be mentioned, for example, hydroquinones, catechols, pyrogallols, aminophenols (e.g. p-aminophenols and o-aminophenols), naphthohydroquinones (e.g. 1,2-naphthalenediols, 1,4-naphthalenediols and 2,6-naphthalenediols) or aminonaphthols (e.g. 1,2-aminonaphthols, 1,4-aminonaphthols and 2,6-aminonaphthols). Here, an amino group is preferably substituted with a sulfonyl group having 1 to 25 carbon atoms or an acyl group having 1 to 25 carbon atoms. As a sulfonyl group, there may be mentioned an aliphatic sulfonyl group which may have a substituent or an aromatic sulfonyl group. As an acyl group, there may be mentioned an aliphatic acyl group or an aromatic acyl group, which may have a substituent. The hydroxyl group or amino group which forms a redox mother nucleus of $ED^1$ may be protected by a group which can be hydrolyzed at the time of development processing, and as a group which can be hydrolyzed, there may be mentioned, for example, an acyl group, a carbonate group, a sulfonyl group, a cyanoethyl group, a sulfonylethyl group, an acylethyl group and an imidomethyl group. Further, this protective group may be mutually bonded to a substituent of $ED^1$ described below to form a 5-, 6- or 7-membered ring.

Suitable positions of the redox mother nucleus represented by $ED^1$ may be substituted by suitable substituents. As an example of these substituents, there may be mentioned those having 25 or less carbon atoms, for example, an alkyl group, an aryl group, an alkylthio group, an arylthio group, an alkoxy group, an aryloxy group, an amino group, an amide group, a sulfonamide group, an alkoxycarbonylamino group, an ureido group, a carbamoyl group, an alkoxycarbonyl group, a sulfamoyl group, a sulfonyl group, a cyano group, a halogen atom, an acyl group, a carboxyl group, a sulfo group, a nitro group and a heterocyclic residue. These substituents may be further substituted with the substituents described above. Further, these substituents may be bonded to each other, if possible, to form a saturated or unsaturated carbon ring, or a saturated or unsaturated hetero ring.

A preferred example of $ED^1$ may include hydroquinone, catechol, pyrogallol, p-aminophenol, o-aminophenol, 1,4-naphthalenediol and 1,4-aminonaphthol. $ED^1$ is more preferably hydroquinone, catechol, pyrogallol, p-aminophenol and o-aminophenol. $ED^1$ is most preferably hydroquinone.

In the formula (IIb), $ED^2$ represents a redox mother nucleus obeying Kendall-Pelz Law, and may specifically include the mother nucleus mentioned in the description of $ED^1$ in the formula (IIa), and pyrazolidones, hydrazines, hydroxyamines and reductones. Here, the hydroxyl group or amino group which forms a redox mother nucleus of $ED^2$ may be protected by a group which can be hydrolyzed mentioned in the description of the formula (IIa). The amino group may be substituted with the sulfonyl group and acyl group mentioned in the description of the formula (IIa) or $-(L)_m-A_1-$. Suitable positions of the redox mother nucleus represented by $ED^2$ may be substituted by suitable substituents. As an example of these substituents, there may be mentioned the substituents mentioned in the description of $ED^1$ in the formula (IIa). These substituents may be bonded to each other, if possible, to form a saturated or unsaturated carbon ring, or a saturated or unsaturated hetero ring.

$A_1$ represents an acidic group, more specifically

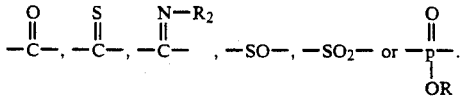

Here, R represents a substituted or unsubstituted alkyl group, a substituted or unsubstituted aryl group, or a substituted or unsubstituted heterocyclic group. As a substituent, there may be mentioned an alkyl group, an aryl group, a hydroxy group, a halogen atom, an alkoxy group, an aryloxy group, an amino group, an acylamino group, a sulfonamide group, a carbamoyl group, a sulfamoyl group, an alkylthio group, an ureido group, a thioureido group, an acyl group, a sulfonyl group, a cyano group, a nitro group and a heterocyclic group.

$R_2$ represents a hydrogen atom or R.

As an acidic group represented by $A_1$,

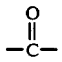

is particularly preferred.

L represents a divalent linking group, and may preferably include alkylene, alkenylene, arylene, oxyalkylene, oxyarylene, aminoalkyleneoxy, aminoalkenyleneoxy, aminoaryleneoxy and an oxygen atom. m represents 0 or 1.

In the formula (IIc), $A_1$ and R have the same meanings as those in the formula (IIb). B represents an acidic group, and specifically represents a nitro group, a cyano group, a carboxy group, a sulfo group or —$A_1$—X—R. X represents a bonding arm, —C—, —S— or

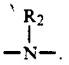

$R_2$ has the same meaning as $R_2$ in the formula (IIb).

$R_1$ represents a hydrogen atom, an alkyl group, an aryl group, an acyl group, a carbamoyl group, an oxycarbonyl group, a sulfonyl group, a sulfamoyl group, a heterocyclic group or

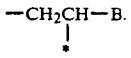

In the formula (IId), R has the same meaning as R described above.

The compound residues represented by the above formulae (IIa) to (IId) are oxidized by an oxidized product of a developing agent, and then cleave —(Time)$_n$— by attack of a nucleophilic agent (e.g. hydroxyl ions, sulfite ions, hydroxylamines, amines, hydroxamic acids, hydrazines, N-oximes, alkoxide and mercapto anions).

In the above formulae (IIa), (IIb), (IIc) and (IId), a position other than "*" is also necessarily bonded to an FL portion in the formula (I). For example, $ED^1$ in the above formula (IIa), $ED^2$ in (IIb), R in (IIc) and R in (IId) are bonded to an FL portion.

A timing group represented by Time in the formula (I) is used for the purpose of controlling a coupling speed and controlling dispersibility of a group linking to a timing group, which may be used or may not be used depending on the purpose. However, in the present invention, it is preferred not to use a timing group. As a timing group represented by Time, there may be mentioned a timing group which eliminates a photographically useful group by intermolecular nucleophilic substitution reaction after elimination from A by coupling reaction as disclosed in U.S. Pat. No. 4,248,962 and Japanese Unexamined Patent Publication No. 56837/1982, a timing group which eliminates a photographically useful group by electronic transfer through a conjugation system as disclosed in U.K. Patent No. 2,072,363, and Japanese Unexamined Patent Publications No. 154234/1982 and No. 188035/1982, and a timing group which is a coupling component which can eliminate a photographically useful group by coupling reaction with an oxidized product of an aromatic primary amine developing agent as disclosed in Japanese Unexamined Patent Publication No. 111536/1982.

In the above formula (I), FL represents a group which emits fluorescence by cleavage of —(Time)$_n$—.

Such an FL portion is described in the following literatures.

(1) Recent Progress Chem. Nat. and Synth., Colourling Matters and Related Fields; (2) Gore, Joshi, Sunthankar and Tilak editors, Academic Press, New York, N.Y., 1962, pp. 1 to 11; (3) Angewandte Chemic International Edition in English, Vol. 14 (1975), No. 10, pp. 665 to 679; (4) Kirk-Othmer Encyclopedia of Chemical Technology, 3rd edition, Vol. 4, pp. 213 to 226, John Wiley & Sons, 1978; (5) Cooke et al, Australian J. Chem., Vol. 28, pp. 1053 to 1057 (1975); (6) Cook et al, Australian J. Chem., Vol. 30, pp. 2241 to 2247 (1977); (7) Chaffee et al, Australian J. Chem., Vol. 34, pp. 587 to 598 (1981); (8) Cooke et al, Australian J. Chem., Vol. 11, pp. 230 to 235 (1958); and (9) European Patent No. 060518 B1 (published on Jul. 17, 1985).

The FL portion is preferably compounds represented by the following formulae (IIIa) to (IIId).

(IIIa)

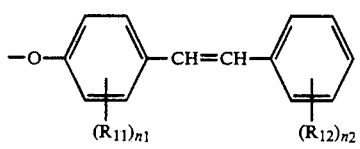

(IIIb)

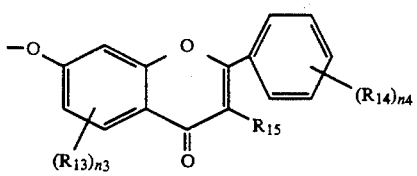

(IIIc)

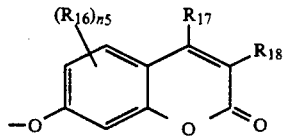

(IIId)

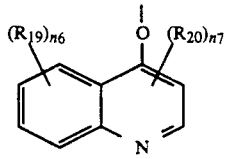

Substituents of $R_{11}$ to $R_{20}$ are substituents which do not lose fluorescence of the FL portion, and may preferably include a halogen atom, a nitro group, a cyano group, a sulfonamide group, a hydroxyl group, a carboxyl group, an alkyl group, an alkoxy group, a carbonyloxy group, an acylamino group, an aryl group, an amino group, a carbamoyl group and an oxycarbonyl group.

The above respective groups may include those having a substituent, and as a preferred substituent, there may be mentioned a halogen atom, a nitro group, a cyano group, a sulfonamide group, a hydroxyl group, a carboxyl group, a substituted or unsubstituted alkyl group, a substituted or unsubstituted alkoxy group, a carbonyloxy group, an acylamino group and a substituted or unsubstituted aryl group.

$n_1$ represents an integer of 0 to 4, $n_2$ 0 to 5, $n_3$ 0 to 3, $n_4$ 0 to 5, $n_5$ 0 to 3, $n_6$ 0 to 3, and $n_7$ 0 to 2, respectively.

At least one of $R_{11}$ and $R_{12}$ in the above (IIIa), $R_{13}$ to $R_{15}$ in (IIIb), $R_{16}$ to $R_{18}$ in (IIIc) and $R_{19}$ to $R_{20}$ in (IIId), respectively, is necessarily bonded to an A portion.

In the following, specific examples of the compound represented by the formula (I) are shown, but the present invention is not limited to these.

F-1

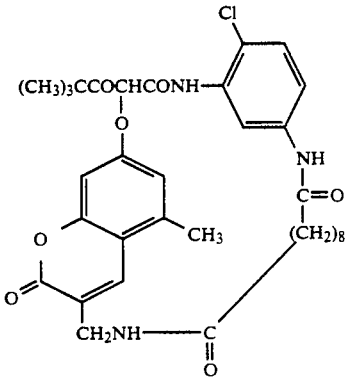

F-2

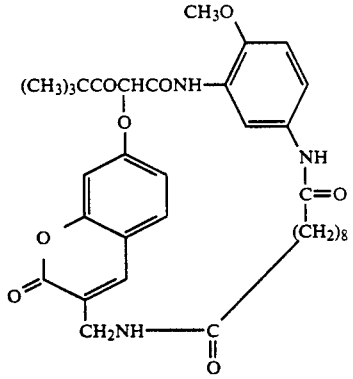

F-3

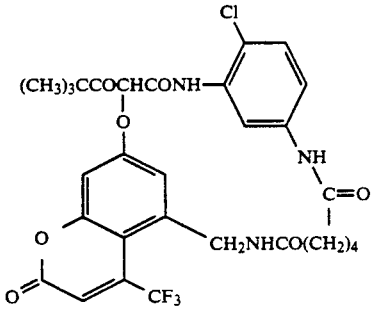

-continued

F-4

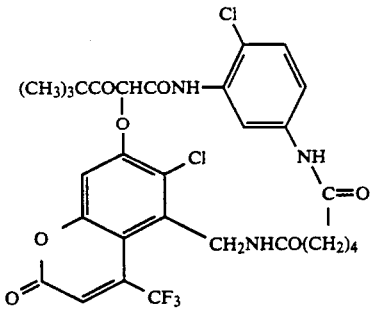

F-5

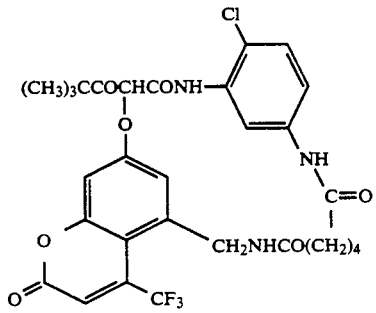

F-6

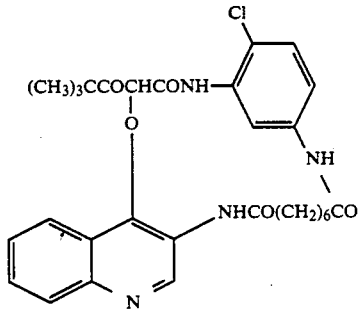

F-7

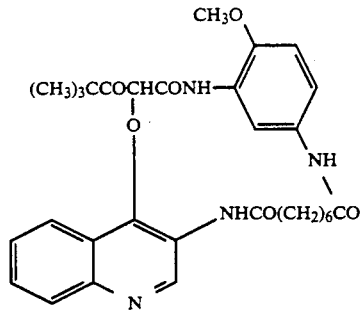

F-8

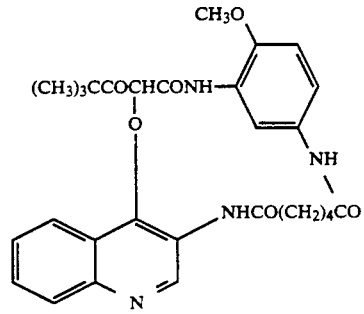

-continued
F-9
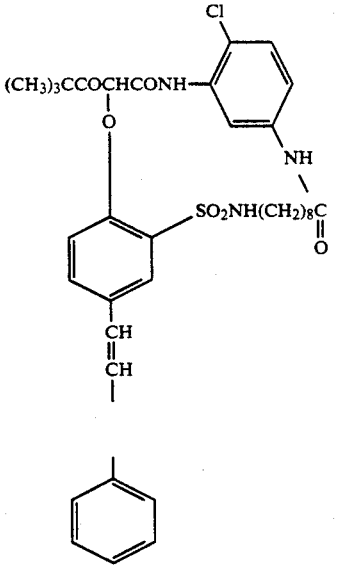
F-10
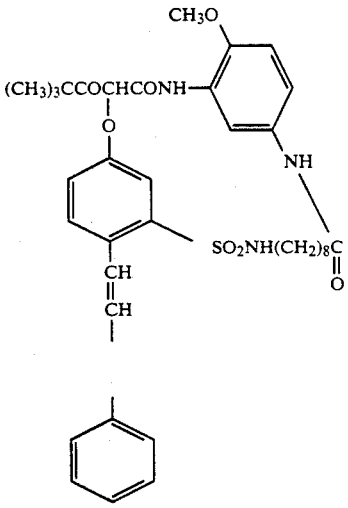
F-11
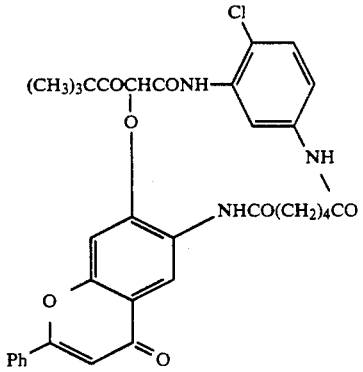
-continued
F-12
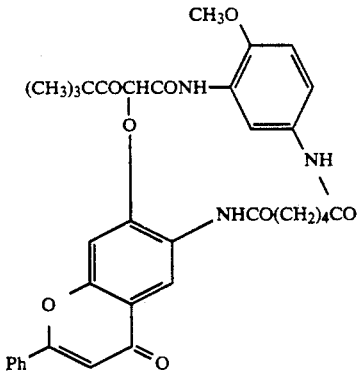
Synthesis of Exemplary compound F-7
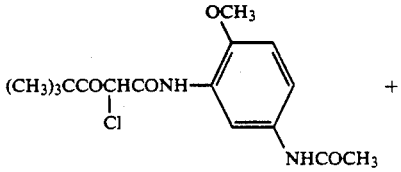
Compound 1
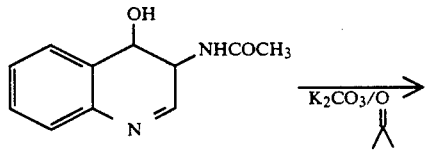
Compound 2
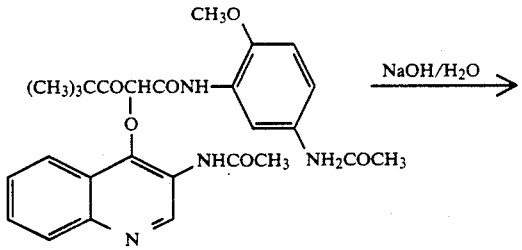
Compound 3
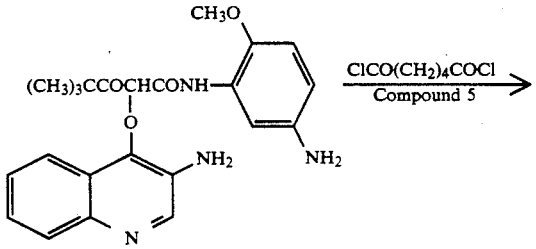
Compound 4

-continued

Synthesis of Exemplary compound F-7

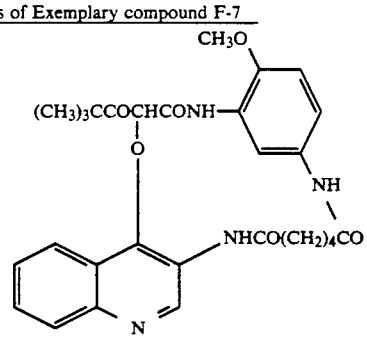

Synthesis of Compound 3

0.1 mole of Compound 2 was dissolved in 100 ml of acetone, and 0.1 mole of $K_2CO_3$ was added, followed by stirring. To the solution, 0.1 mole of Compound 1 was added, and the mixture was reacted for 4 hours under reflux by heating. After completion of the reaction, the reaction mixture was poured into 1 liter of water, and crystals formed were separated by filtration to obtain 87 mmole of crude crystals of Compound 3.

These crystals were used without purification in the next step.

Synthesis of Compound 4

70 mmole of crude crystals of Compound 3 were dispersed in 2.1 mole of NaOH/500 ml of $H_2O$, and the solution was reacted for 5 hours under reflux by heating. After cooling, crystals formed were separated by filtration, and then recrystallized from ethanol to obtain 59 mmole of Compound 4. Its structure was confirmed by NMR and MASS.

Synthesis of Exemplary compound F-7

50 mmole of crystals of Compound 4 were dissolved in 200 ml of ethyl acetate and 100 mmole of pyridine, and 50 mmole of Compound 5 was added thereto, and the mixture was reacted at room temperature for one hour and then for 2 hours under reflux. After completion of the reaction, the reaction mixture was washed, and an organic layer was evaporated to dryness, followed by purification by a column chromatography, to obtain 20 mmole of a desired compound F-7.

Its structure was confirmed by NMR and MASS.

The compound represented by the above formula (I) of the present invention is used preferably in an amount of $1\times10^{-3}$ mole to 5 mole, more preferably in the range of $1\times10^{-2}$ mole to 1 mole per mole of silver halide, and may be used in combination with other conventional dye image-forming couplers.

In the present invention, as a yellow dye-forming coupler, acylacetanilide type couplers can be preferably used. Among these couplers, benzoylacetanilide type and pivaloylacetanilide type compounds are advantageous.

As a magenta dye-forming coupler, magenta-dye forming couplers such as 5-pyrazolone type couplers, pyrazoloazole type couplers and pyrazolobenzimidazole type couplers can be used.

As a cyan dye-forming coupler, naphthol type couplers and phenol type couplers can be preferably used.

The hydrophobic compounds such as the above dye-forming couplers are generally dissolved in a high boiling point organic solvent having a boiling point of about 150° C. or higher or a water-insoluble polymer, and if necessary, in combination with a low boiling point and/or water-soluble organic solvent, and dispersed by emulsification in a hydrophilic binder such as an aqueous gelatin solution by using a surfactant, and thereafter added in a desired hydrophilic colloid layer. A step of removing a dispersion or removing a low boiling point organic solvent simultaneously with dispersion may be employed.

The high boiling point organic solvent is preferably a compound having a dielectric constant of 6.5 or less, for example, esters such as phthalate and phosphate, organic acid amides, ketones and hydrocarbon compounds each having a dielectric constant of 6.5 or less, more preferably a high boiling point organic solvent having a dielectric constant of 1.9 to 6.5 and having a steam pressure at 100° C. of 0.5 mmHg or less. Among these solvents, phthalates or phosphates are more preferred. Most preferred is dialkyl phthalate having an alkyl group with 9 or more carbon atoms. Further, the high boiling point organic solvent may comprise a mixture of two or more kinds.

The dielectric constant refers to a dielectric constant at 30° C.

These high boiling point organic solvents are used generally at a rate of 0 to 400% by weight based on a coupler, preferably 10 to 100% by weight based on a coupler.

The light-sensitive silver halide photographic material of the present invention can be, for example, negative and positive films of a color negative and a color printing paper. However, when a color printing paper provided to direct observation is used, the effect of the present invention can be exhibited particularly favorably.

The light-sensitive silver halide photographic material of the present invention including this color printing paper may be monochromatic or polychromatic.

In the present invention, silver bromide, silver iodobromide, silver iodochloride, silver chlorobromide and silver chloride which are generally used in a silver halide emulsion can be used as desired.

The silver halide emulsion to be used in the present invention is chemically sensitized according to the sulfur sensitization method, the selenium sensitization method, the reduction sensitization method and the noble metal sensitization method.

The silver halide emulsion to be used in the present invention can be optically sensitized to a desired wavelength region by using a dye which is known as a sensitizing dye in the field of photography.

In the present invention, there can be also used a hydrophilic colloid such as gelatin used in a common light-sensitive silver halide photographic material or otherwise gelatin derivatives, graft polymers of gelatin and other polymers, proteins, sugar derivatives, cellulose derivatives and synthetic hydrophilic polymers of homopolymers or copolymers. In the present invention, conventional hardeners and UV absorbers can be also used.

The water-soluble dye preferably used in auxiliary layers such as a filter layer, an antihalation layer or an anti-iradiation layer in the light-sensitive silver halide photographic material of the present invention is represented by the following formula (A-1).

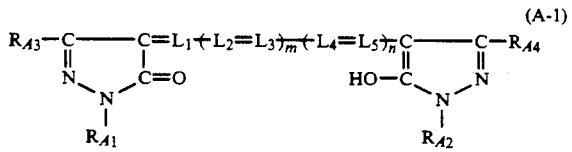

(A-1)

In the formula, $L_1$, $L_2$, $L_3$, $L_4$ and $L_5$ each represent a methine group, and m and n each represent 0 or 1.

$R_{A1}$ and $R_{A2}$ each represent a hydrogen atom, an alkyl group, an aralkyl group, an aryl group and a heterocyclic group.

The alkyl group represented by $R_{A1}$ and $R_{A2}$ may include, for example, straight, branched or cyclic groups such as methyl, ethyl, propyl, isopropyl, n-butyl and cyclohexyl, the aralkyl group, for example, benzyl and phenetyl, the aryl group, for example, phenyl and naphthyl, and the heterocyclic group, for example, benzothiazolyl, pyridyl, pyrimidyl and sulforanyl, respectively. However, the alkyl group, aralkyl group and aryl group are preferred.

The alkyl group, aralkyl group, aryl group and heterocyclic group represented by $R_{A1}$ and $R_{A2}$ can have various substituents, and may include, for example, sulfo, carboxy, hydroxy, cyano, halogen (e.g. fluorine and chlorine), alkyl (e.g. methyl, isopropyl, trifluoromethyl, t-butyl, ethoxycarbonylmethyl and sulfomethyl), amino (e.g. amino, dimethylamino, sulfoethylamino, piperidino and morpholino), alkoxy (e.g. methoxy, ethoxy and sulfopropoxy), sulfonyl (e.g. methanesulfonyl and ethanesulfonyl), sulfamoyl (e.g. sulfamoyl and dimethylsulfamoyl), acylamino (e.g. acetamide, benzamide and sulfobenzamide), carbamoyl (e.g. carbamoyl, phenylcarbamoyl and sulfophenylcarbamoyl), sulfonamide (e.g. methanesulfonamide and benzenesulfonamide), alkoxycarbonyl (e.g. ethoxycarbonyl, hydroxyethoxycarbonyl and benzyloxycarbonyl) and aryloxycarbonyl (e.g. phenoxycarbonyl and nitrophenoxycarbonyl).

The aralkyl group and aryl group represented by $R_{A1}$ and $R_{A2}$ have desirably at least one group of a sulfo group, a carboxy group and a phosphoric acid group, more preferably at least one sulfo group on their aromatic nuclei.

In the formula, $R_{A3}$ and $R_{A4}$ each represent an alkyl group, an aryl group, an aralkyl group, a heterocyclic group, a carboxy group, an alkoxycarbonyl group, an aryloxycarbonyl group, a carbamoyl group, a ureido group, a thioureido group, an acylamino group, an acyl group, an imide group, a cyano group, a hydroxy group, an alkoxy group and an amino group.

Specific examples of the alkyl group, alkoxycarbonyl group, aryloxycarbonyl group, carbamoyl group, acylamino group, alkoxy group and amino group represented by $R_{A3}$ and $R_{A4}$ may include the same specific examples as the substituent introduced to the alkyl group, aralkyl group, aryl group and heterocyclic group represented by $R_{A1}$ and $R_{A2}$. Further, the aryl group represented by $R_{A3}$ and $R_{A4}$ may include, for example, phenyl, sulfopropoxyphenyl, cyanophenyl, carboxyphenyl, nitrophenyl and sulfophenyl, the aralkyl group may include benzyl, phenethyl and sulfobenzyl, the heterocyclic group may include furyl and thienyl, the ureido group may include methylureido and phenylureido, the thioureido group may include methylthioureido and phenylthioureido, the imide group may include succinimide and phthalimide, and the acyl group may include acetyl and pivalyl, respectively.

Specific examples of the water-soluble dye compound are shown below, but the scope of the present invention is not limited to these.

Exemplary dye
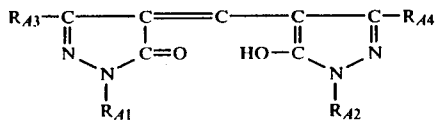
| Exemplary No. | $R_{A3}$ | $R_{A4}$ | $R_{A1}$ | $R_{A2}$ |
|---|---|---|---|---|
| 1 | —CN | —CN | 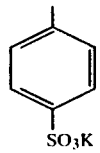 | 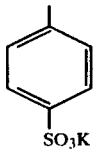 |
| 2 | —CN | —CN | 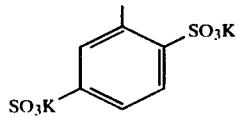 | 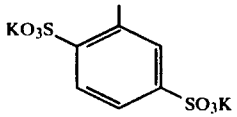 |
| 3 | —CN | —CN | 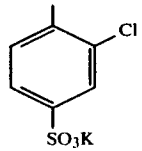 | 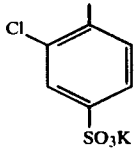 |
| 4 | $—CF_3$ | $—CF_3$ | 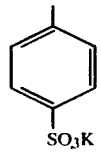 | 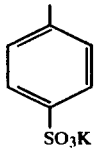 |
| 5 | $—COOCH_3$ | $—COOCH_3$ | 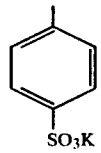 | 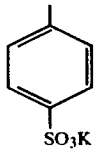 |

-continued
| | | | | |
|---|---|---|---|---|
| 6 | $-COCH_3$ | $-COCH_3$ | 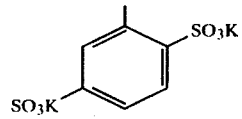 | 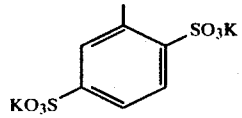 |
| 7 | $-COCH_3$ | $-CONH_2$ | 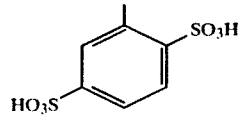 | 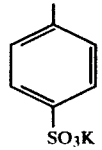 |
| 8 | $-CONHCF_3$ | $-CONHCF_3$ | 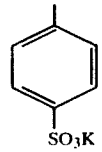 | 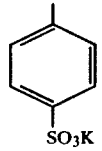 |
| 9 | $-CH_3$ | $-CH_3$ | 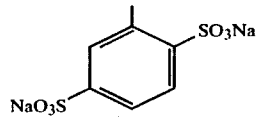 | 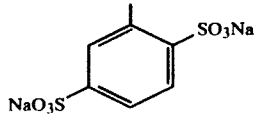 |
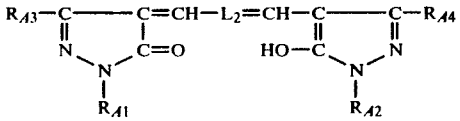
| Exemplary No. | $R_{A3}$ | $R_{A4}$ | $L_2$ | $R_{A1}$ | $R_{A2}$ |
|---|---|---|---|---|---|
| 10 | $-CN$ | $-CN$ | $-CH=$ | 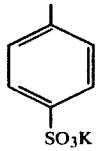 | 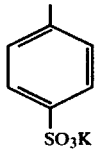 |

-continued
| | | | | | |
|---|---|---|---|---|---|
| 11 | —CN | —CN | —CH= | 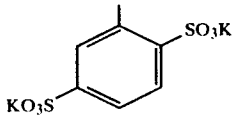 | 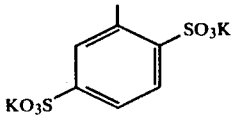 |
| 12 | —CN | —CN | —CH= | 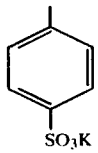 | 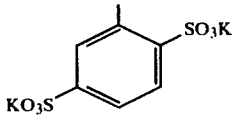 |
| 13 | —CN | —CN | —CH= | 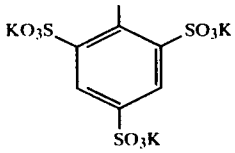 | 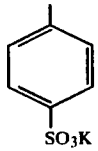 |
| 14 | —CN | —CN | —CH= | 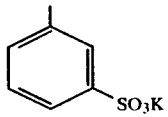 | 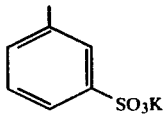 |
| 15 | —CN | —CN | —CH= | 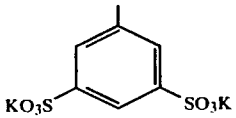 | 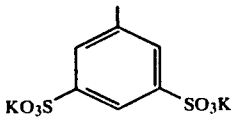 |
| 16 | —CN | —CN | —CH= | 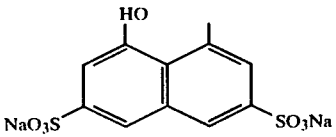 | 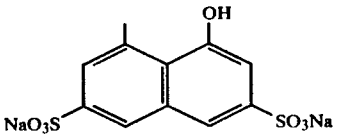 |
| 17 | —CN | —CN | $C_2H_5$ \| —C= | 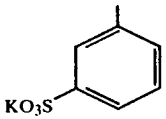 | 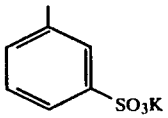 |

-continued
| | | | | | |
|---|---|---|---|---|---|
| 18 | —CN | —CN | —CH= | 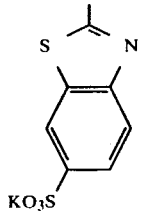 | 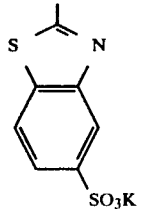 |
| 19 | —$CF_3$ | —$CF_3$ | —CH= | 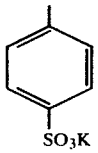 | 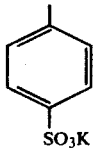 |
| 20 | —$CF_3$ | —$CF_3$ | —CH= | 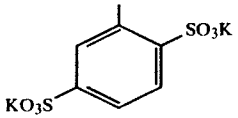 | 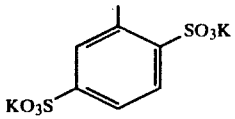 |
| 21 | —$CONH_2$ | —$CONH_2$ | —CH= | 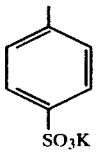 | 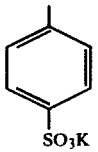 |
| 22 | —$CONH_2$ | —CN | —CH= | 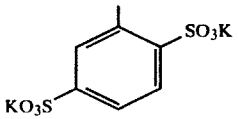 | 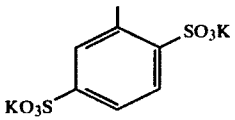 |
| 23 | —$CONH_2$ | —$CONH_2$ | —CH= | 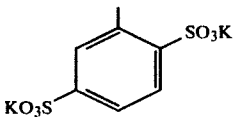 | 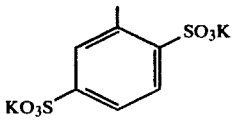 |

-continued
| | | | | | |
|---|---|---|---|---|---|
| 24 | $-CONH_2$ | $-CONH_2$ | $-CH=$ | 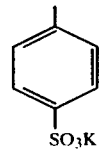 | 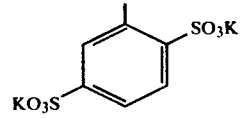 |
| 25 | $-CONH_2$ | $-CONH_2$ | $-\overset{CH_3}{\overset{\vert}{C}}=$ | 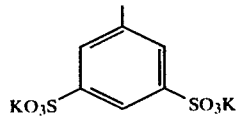 | 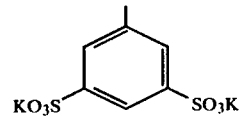 |
| 26 | $-CONH_2$ | $-CONH_2$ | $-CH=$ | 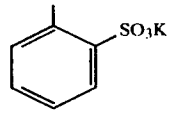 | 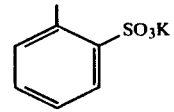 |
| 27 | $-CONH_2$ | $-CONH_2$ | $-CH=$ | 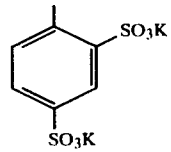 | 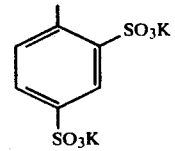 |
| 28 | $-CF_3$ | $-CF_3$ | $-CH=$ | 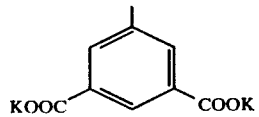 | 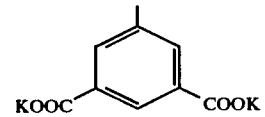 |
| 29 | $-CF_3$ | $-CF_3$ | $-CH=$ | 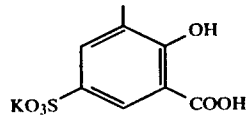 | 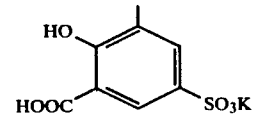 |
| 30 | $-CONH_2$ | $-CN$ | $-CH=$ | 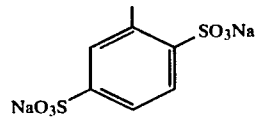 | 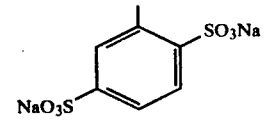 |

-continued
| | | | | | |
|---|---|---|---|---|---|
| 31 | $-(CF_2)_2H$ | $-(CF_2)_2H$ | $-CH=$ | 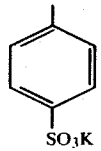 | 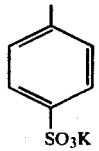 |
| 32 | $-(CF_2)_4H$ | $-(CF_2)_4H$ | $-CH=$ | 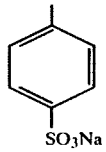 | 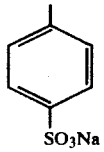 |
| 33 | $-CF_2H$ | $-CF_2H$ | $-CH=$ | 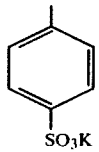 | 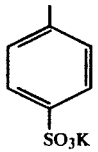 |
| 34 | 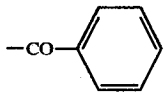 | $-CONH_2$ | $-CH=$ | 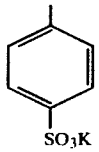 | 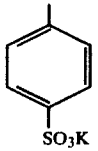 |
| 35 | 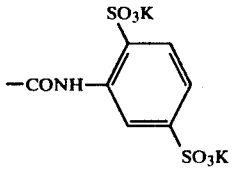 | 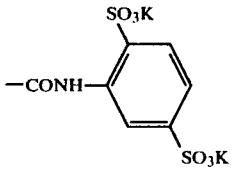 | $-CH=$ | $-CH_3$ | $-CH_3$ |
| 36 | $-COCH_3$ | $-CF_3$ | $-CH=$ | 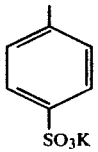 | 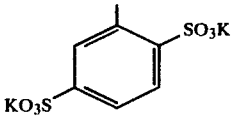 |

-continued
| | | | | | |
|---|---|---|---|---|---|
| 37 | $-COCH_3$ | $-COCH_3$ | $-CH=$ | 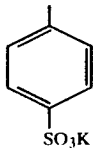 | 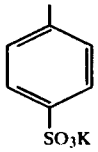 |
| 38 | $-COCH_3$ | $-COCH_3$ | $-CH=$ | 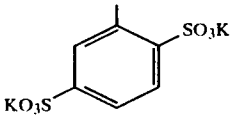 | 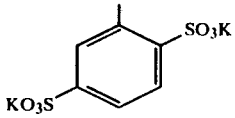 |
| 39 | $-COCH_3$ | $-COCH_3$ | $-\overset{C_2H_5}{\overset{\vert}{C}}=$ | 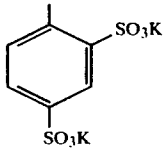 | 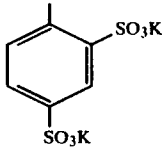 |
| 40 | $-COCH_3$ | $-COCH_3$ | $-CH=$ | 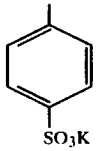 | 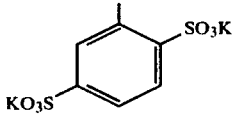 |
| 41 | $-COC_2H_5$ | $-COC_2H_5$ | $-CH=$ | 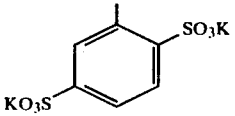 | 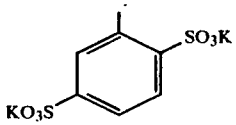 |
| 42 | 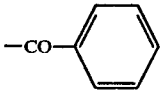 | 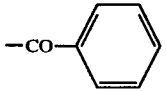 | $-CH=$ | 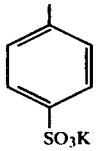 | 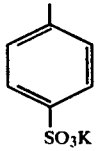 |

-continued
| | | | | | |
|---|---|---|---|---|---|
| 43 | $-(CF_2)_5H$ | $-(CF_2)_5H$ | $-CH=$ | 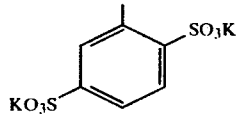 | 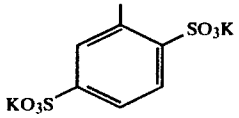 |
| 44 | $-CONH(CF_2)_4H$ | $-CONH(CF_2)_4H$ | $-CH=$ | 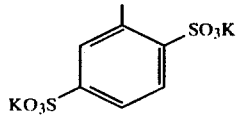 | 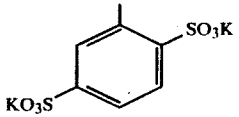 |
| 45 | $-COOH$ | $-COOH$ | $-CH=$ | 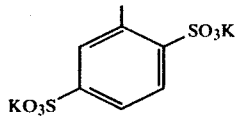 | 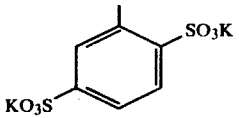 |
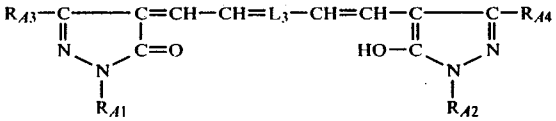
| Exemplary No. | $R_{A3}$ | $R_{A4}$ | $L_3$ | $R_{A1}$ | $R_{A2}$ |
|---|---|---|---|---|---|
| 52 | $-CN$ | $-CN$ | $=CH-$ | 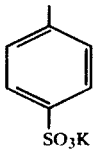 | 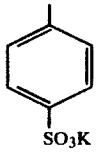 |
| 53 | $-CN$ | $-CN$ | $=CH-$ | 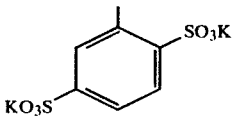 | 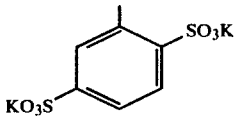 |
| 54 | $-CN$ | $-CN$ | $=CH-$ | 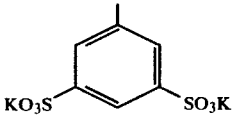 | 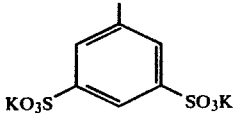 |

-continued
| | | | | | |
|---|---|---|---|---|---|
| 55 | —CN | —$COCH_3$ | =CH— | 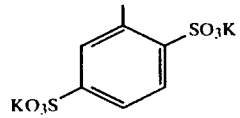 | 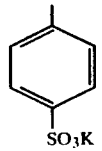 |
| 56 | —CN | —CN | =CH— | 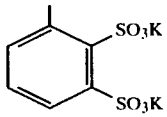 | 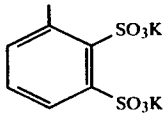 |
| 57 | —CN | —CN | $C_2H_5$ \| =C— | 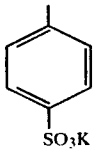 | 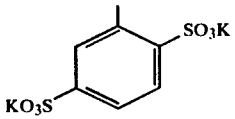 |
| 58 | —CN | —CN | =CH— | 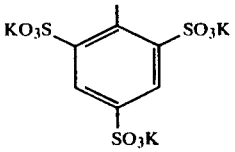 | 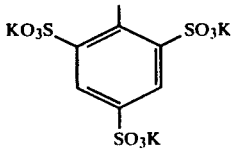 |
| 59 | —CN | —CN | =CH— | 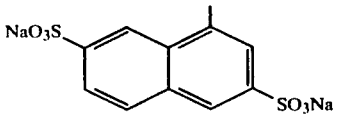 | 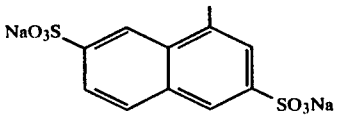 |
| 60 | —CN | —CN | 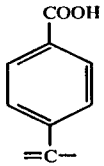 | 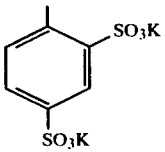 | 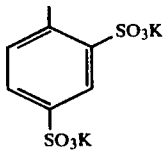 |

-continued
| | | | | | |
|---|---|---|---|---|---|
| 61 | —CN | —CN | =CH— | 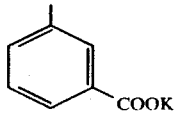 | 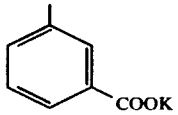 |
| 62 | —CN | —CN | =CH— | 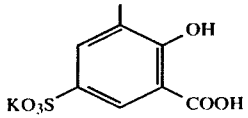 | 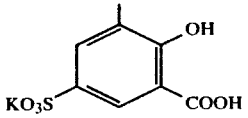 |
| 63 | $—CF_3$ | $—CF_3$ | =CH— | 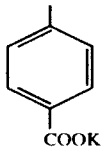 | 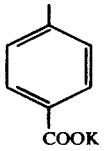 |
| 64 | $—COCH_3$ | $—CONH_2$ | =CH— | 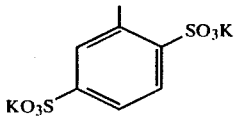 | 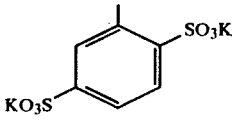 |
| 65 | $—CF_3$ | $—CF_3$ | =CH— | 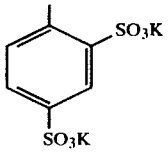 | 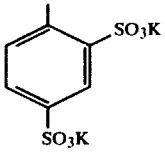 |
| 66 | $—(CF_2)_2F$ | $—(CF_2)_2F$ | =CH— | 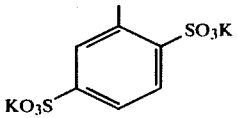 | 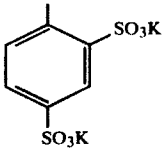 |

-continued
| | | | | | |
|---|---|---|---|---|---|
| 67 | —CN | —CO— 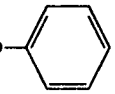 | =CH— | 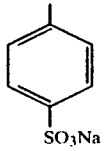  | 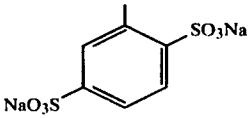  |
| 68 | —COO— 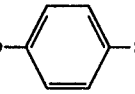 —SO3K | —COO— 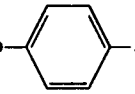 —SO3K | =CH— | —CH=CH—CH3 | —CH=CH—CH3 |
| 69 | —CONH2 | —CONH2 | =CH— | 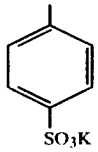  | 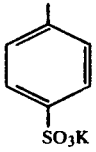  |
| 70 | —CONH2 | —CONH2 | =CH— | 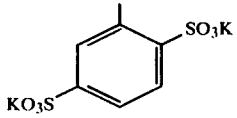  | 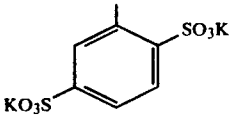  |
| 71 | —CONH2 | —CONH2 | =CH— | 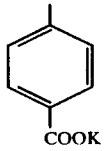  | 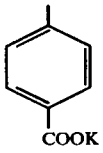  |
| 72 | —CONHCF2 | —CONHCF2 | =CH— | 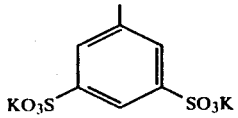  | 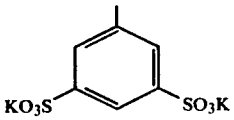  |

-continued
| | | | | | |
|---|---|---|---|---|---|
| 73 | $-COCH_3$ | $-COCH_3$ | $=CH-$ | 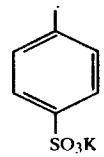 | 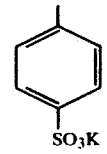 |
| 74 | $-COCH_3$ | $-COCH_3$ | $=CH-$ | 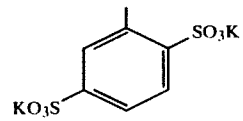 | 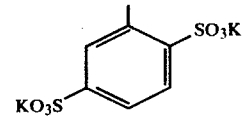 |
| 75 | $-COCH_3$ | $-COCH_3$ | $=CH-$ | 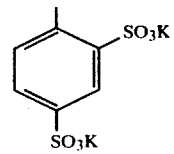 | 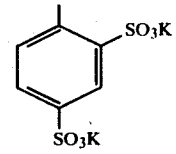 |
| 76 | $-COCH_3$ | $-COCH_3$ | $=CH-$ | 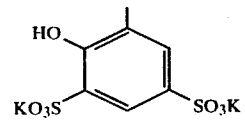 | 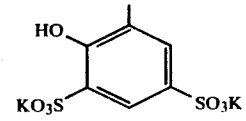 |
| 77 | $-COCH_3$ | $-COCH_3$ | $=CH-$ | 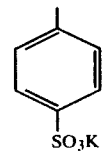 | 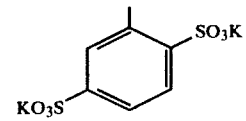 |
| 78 | $-COCH_3$ | $-COCH_3$ | $=CH-$ | 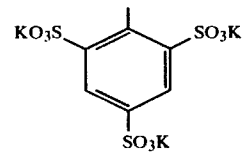 | 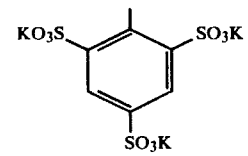 |

-continued
| | | | | | |
|---|---|---|---|---|---|
| 79 | $-CN$ | $-COCH_3$ | $=CH-$ | 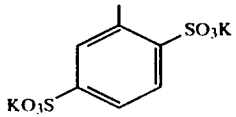 | 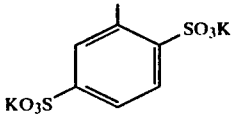 |
| 80 | $-COCH_3$ | $-COCH_3$ | $=CH-$ | 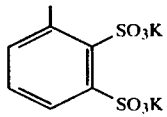 | 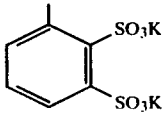 |
| 81 | $-COCH_3$ | $-COCH_3$ | $=CH-$ | 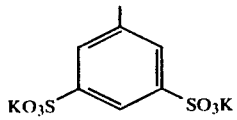 | 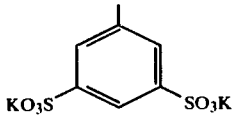 |
| 82 | 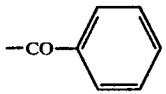 | 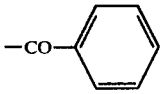 | $=CH-$ | 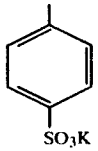 | 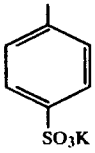 |
| 83 | 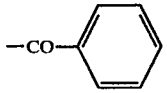 | 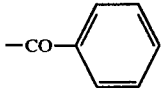 | $=CH-$ | 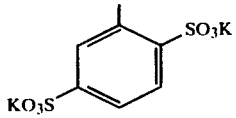 | 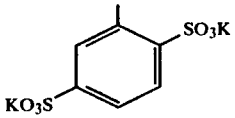 |
| 84 | $-COCH_3$ | $-COCH_3$ | $=C(C_3H_7(i))-$ | 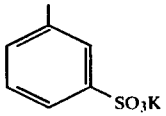 | 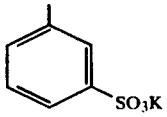 |
| 85 | $-COOH$ | $-COOH$ | $=CH-$ | 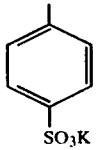 | 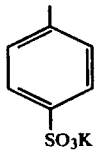 |

-continued
| | | | | | |
|---|---|---|---|---|---|
| 86 | $-COOC_2H_5$ | $-COOC_2H_5$ | $=CH-$ | 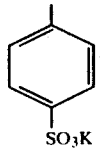 | 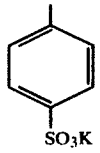 |
| 87 | 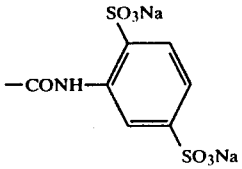 | 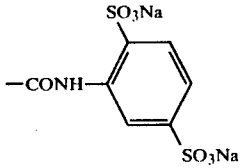 | $=CH-$ | $-CH_3$ | $-CH_3$ |
| 88 | $-CONHCH_2CH_2OH$ | $-CONHCH_2CH_2OH$ | $=CH-$ | 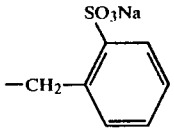 | 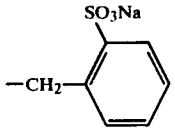 |
| 89 | $-COO(CH_2)_3OH$ | $-COO(CH_2)_3OH$ | $=CH-$ | 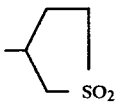 | 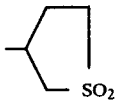 |
| 90 | $-CONHCH_2CH_2OH$ | $-CONHCH_2CH_2OH$ | $=CH-$ | 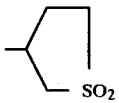 | 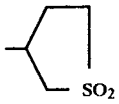 |
91
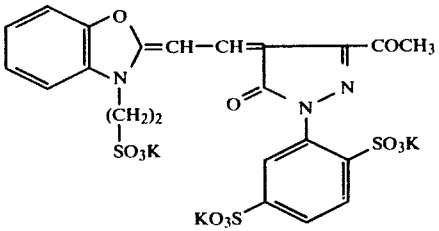

-continued
| | |
|---|---|
| 92 | 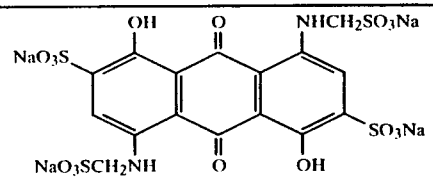 |
| 93 | 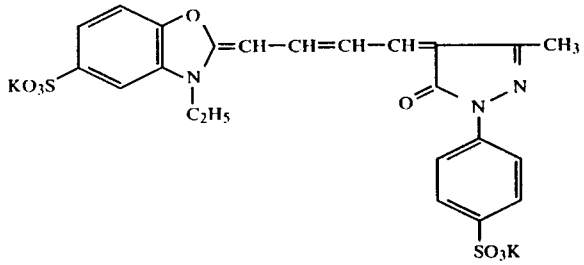 |
| 94 | 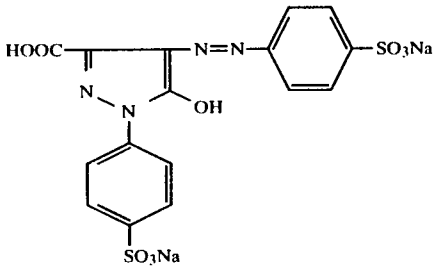 |

In the present invention, conventional matte agents, lubricants for reducing slipping friction and antistatic agents can be added.

In the present invention, various conventional surfactants are used.

In the light-sensitive silver halide photographic material of the present invention, supports generally used and a thin type reflective support with a thickness of 120 to 160 μm can be also used.

When the light-sensitive photographic material using the silver halide emulsion of the present invention is coated, a thickener may be used for increasing coatability. As a coating method, extrusion coating and curtain coating by which two or more layers can be coated simultaneously are particularly useful.

Processing steps of the light-sensitive silver halide photographic material of the present invention are not limited, and conventional steps widely used in various color photographic processings can be used.

In the following, specific Examples of the present invention are described, but the embodiment of the present invention is not limited to these Examples.

EXAMPLES

EXAMPLE 1

According to the neutral method and double jet method, 3 kinds of silver halide emulsions shown in Table 1 were prepared.

TABLE 1

| Emulsion No. | AgCl % | AgBr % | Average grain size (μm) | Chemical sensitizer | Spectral sensitizing dye |
|---|---|---|---|---|---|
| Em-1 | 10 | 90 | 0.67 | Sodium thiosulfate*1 | SD-1*2 |
| Em-2 | 30 | 70 | 0.46 | | SD-2*3 |
| Em-3 | 30 | 70 | 0.43 | | SD-3*4 |

*1added in an amount of 2 mg per mole of silver halide
*2added in an amount of 0.9 mmole per mole of silver halide
*3added in an amount of 0.7 mmole per mole of silver halide
*4added in an amount of 0.2 mmole per mole of silver halide After completion of chemical sensitization, to the respective silver halide emulsions was added STB-1 shown below in an amount of $2\times10^{-4}$ mole of per mole of silver halide as an emulsion stabilizer.

SD-1

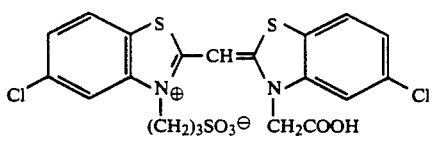

SD-2

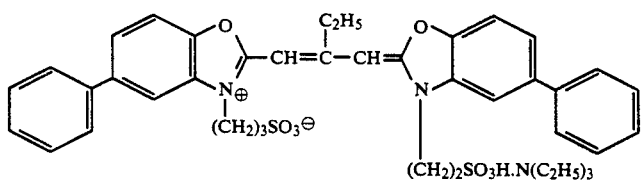

SD-3

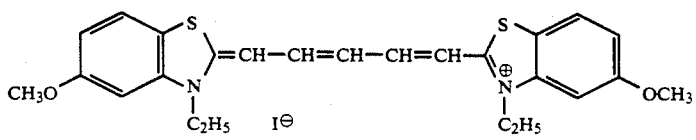

STB-1

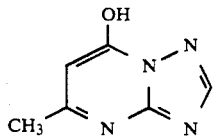

Subsequently, the following Layers 1 to 7 were provided by coating (simultaneous coating) successively on a paper support of which both surfaces had been coated with polyethylene to prepare a light-sensitive silver halide color photographic material 1. (In the following Examples, amounts added are represented in an amount per 1 $dm^2$ of the light-sensitive material.)

Layer 1 . . . A layer containing 12 mg of gelatin, 3.0 mg (calculated on silver, hereinafter the same) of a blue-sensitive silver halide emulsion (Em-1) and 8.0 mg of a yellow coupler (Y-1) dissolved in 3 mg of dinonyl phthalate (DNP).

Layer 2 . . . A layer containing 9 mg of gelatin and 0.4 mg of HQ-1 dissolved in 2 mg of dioctyl phthalate (DOP).

Layer 3 . . . A layer containing 14 mg of gelatin and 2.5 mg of a green-sensitive silver halide emulsion (Em-2) and 4 mg of a magenta coupler (M-1) dissolved in 3 mg of DOP.

Layer 4 . . . A layer containing 12 mg of gelatin, 8 mg of UV absorber UV-1 shown below and 0.5 mg of 2,5-dioctylhydroquinone (HQ-1) dissolved in 4 mg of DNP.

Layer 5 . . . A layer containing 14 mg of gelatin, 2.5 mg of a red-sensitive silver halide emulsion (Em-3) and 5 mg of a cyan coupler (C-1) dissolved in 5 mg of DOP.

Layer 6 . . . A layer containing 11 mg of gelatin and 4 mg of UV-1 dissolved in 2 mg of DOP.

Layer 7 . . . A layer containing 10 mg of gelatin.

As a hardener, bis(vinylsulfonylmethyl)ether was added.

UV-1

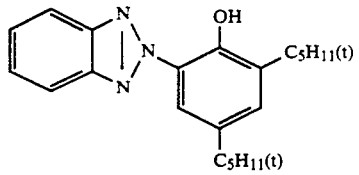

Y-1

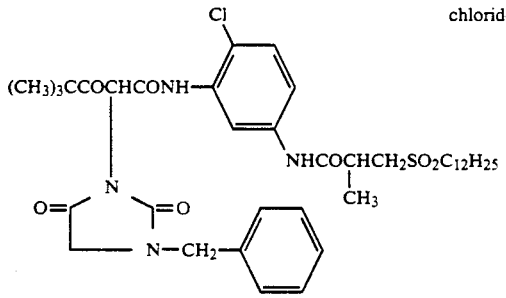

M-1

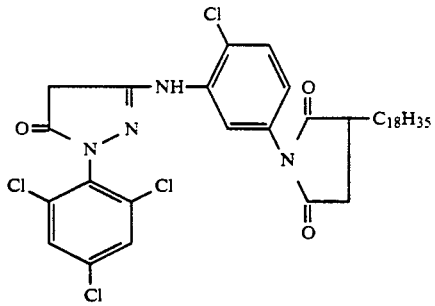

C-1

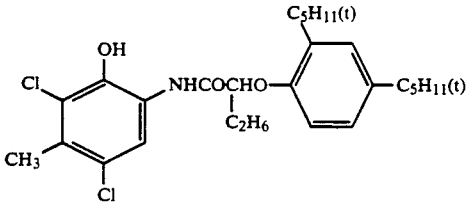

Subsequently, the yellow coupler (Y-1) contained in Layer 1 of Sample 1 was changed as shown in Table 2, and a mordant was added to Layer 6 as shown in Table 2 to prepare Samples 2 to 4.

TABLE 2

| Sample No. | Yellow coupler and present compound in Layer 1 | Mordant in Layer 6 | Remarks |
|---|---|---|---|
| 1 | Y-1 [1.0] | — | Comparative |
| 2 | Y-1 [0.5], Y-2 [0.5] | — | Comparative |
| 3 | Y-1 [0.5], Y-2 [0.5] | P-1 (3 mg) | Comparative |
| 4 | Y-1 [0.5], F-4 [0.5] | — | Present invention |

Figures in square parentheses indicate a molar ratio of Sample 1 to Y-1. A figure in parentheses indicates an amount added.

Y-2: Comparative yellow coupler (yellow coupler disclosed in Japanese Unexamined Patent Publication No. 21446/1989)

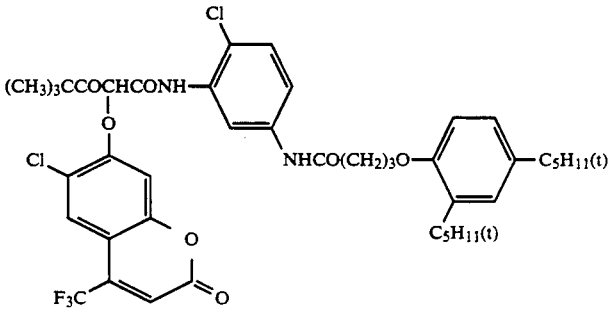

P-1: poly[styrene-CO—N-vinylbenzyl-N,N-dimethylbenzyl-ammonium chloride-CO-divinylbenzene]

These Samples 1 to 4 were subjected to wedge exposure by using blue lights, and then to development processing shown below. For the samples obtained, reflectance $R_{500}$ at 500 nm at a density of 1.0 at 450 nm was measured. The results are shown in Table 3.

| Processing steps (processing temperature and processing time) | | |
|---|---|---|
| (1) Color development | 38° C. | 3 min 30 sec |
| (2) Bleach-fixing | 33° C. | 1 min 30 sec |
| (3) Washing processing | 25 to 30° C. | 3 min |
| (4) Drying | 75 to 80° C. | approx. 2 min. |

Compositions of processing solutions

| (Color developing solution) | |
|---|---|
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N-ethyl-N-(β-methanesulfonamidoethyl)-aniline sulfate | 5.5 g |
| Fluorescent brightener (4,4'-diaminostilbendisulfonic acid derivative) | 1.0 g |
| Potassium hydroxide | 2.0 g |
| made up to 1 liter in total with addition of water, and adjusted pH to 10.20. | |
| (Bleach-fixing solution) | |
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| adjusted pH to 7.1 with potassium carbonate or glacial acetic acid, and made up to 1 liter in total with addition of water. | |

TABLE 3

| Sample No. | $R_{500}$ | Remarks |
|---|---|---|
| 1 | 26% | Comparative |
| 2 | 27% | Comparative |
| 3 | 32% | Comparative |
| 4 | 33% | Present invention |

As clearly shown in Table 3, it can be understood that in Sample No. 4 using the compound of the present invention, reflectance at 500 nm is increased, and unnecessary absorption of the dye formed from the yellow coupler at a longer wavelength side has been corrected effectively. It can be understood that in the case where the Comparative coupler Y-2 is used, when a mordant is not used in combination, correction effect of unnecessary absorption is small.

EXAMPLE 2

For the processed samples obtained in Example 1, light fastness was tested according to the following method.

$\Delta R_{500}$ which is a reflectance change at 500 nm obtained when sunlight was irradiated for 5 days by using an under glass outdoor exposure stand was measured.

$\Delta R_{500} = R_{500}$ after irradiation of sunlight $- R_{500}$ before irradiation of sunlight (%)

The results are shown in Table 4.

TABLE 4

| Sample No. | $\Delta R_{500}$ | Remarks |
|---|---|---|
| 1 | −0.1% | Comparative |
| 2 | −0.5% | Comparative |
| 3 | −2.9% | Comparative |
| 4 | −1.8% | Present invention |

As clearly shown in Table 4, it can be understood that Sample No. 4 of the present invention is excellent in aging stability of lights having effect of correcting unnecessary absorption when compared with Sample No. 3 using the comparative coupler Y-2 and having correction effect of unnecessary absorption.

EXAMPLE 3

The procedures were carried out in the same manner as in Example 1 except for adding a water-soluble dye as shown in the following Table 5 to Layer 6 of Samples No. 3 and No. 4 in Example 1 to prepare Samples No. 6 to No. 9.

TABLE 5

| Sample No. | Yellow coupler in Layer 1 | Mordant in Layer 6 | Water-soluble dye in Layer 6 | Remarks |
|---|---|---|---|---|
| 6 | Y-1 [0.5]<br>Y-2 [0.5] | P-1 (3 mg) | Exemplary dye No. 74 (0.2 mg) | Comparative |
| 7 | Y-1 [0.5]<br>Y-2 [0.5] | P-1 (3 mg) | Exemplary dye No. 87 (0.2 mg) | Comparative |
| 8 | Y-1 [0.5]<br>F-4 [0.5] | — | Exemplary dye No. 74 (0.2 mg) | Present invention |
| 9 | Y-1 [0.5]<br>F-4 [0.5] | — | Exemplary dye No. 87 (0.2 mg) | Present invention |

Figures in square parentheses and parentheses have the same meanings in Table 2 of Example 1.

The samples obtained were subjected to the same development processing as in Example 1, and red density $D_R$ at unexposed portions was measured by using an optical densitometer Model PDA-65 (trade name, manufactured by Konica Corporation).

The results are shown in Table 6.

TABLE 6

| Sample No. | $D_R$ | Remarks |
|---|---|---|
| 6 | 0.12 | Comparative |
| 7 | 0.16 | Comparative |
| 8 | 0.03 | Present invention |
| 9 | 0.03 | Present invention |

As clearly shown in Table 6, it can be understood that even when the water-soluble dye is used in combination, the samples of the present invention are excellent in background whiteness.

According to the present invention, there could be provided a light-sensitive silver halide photographic material in which unnecessary absorption of a dye image can be corrected effectively, aging stability of said effect is excellent and yet background whiteness is excellent.

We claim:

1. A light-sensitive silver halide photographic material having at least one silver halide emulsion layer on a support, characterized in that at least one layer of the above silver halide emulsion layers contains a compound represented by the following formula (I):

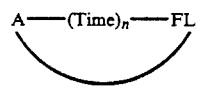

(I)

wherein n represents 0 or 1; A represents a compound residue which cleaves a bonding to Time in the case of n=1 or a compound residue which cleaves one of bondings to FL in the case of n=0; Time represents a timing group which cleaves a bonding to FL after cleavage from A; and FL represents a compound residue which, as a function of development, emits fluorescence by cleavage of a bonding to Time in the case of n=1 and a compound residue which, as a function of development, emits fluorescence by cleavage of one of bondings to A in the case of n=0.

2. The material of claim 1 wherein said A is a coupler residue selected from the group consisting of:

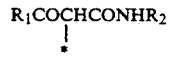

(Ia)

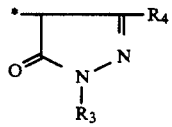

(Ib)

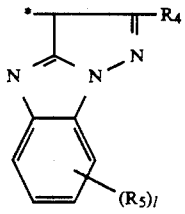

(Ic)

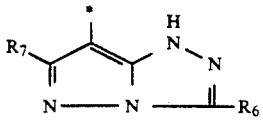

(Id)

-continued (Ie)

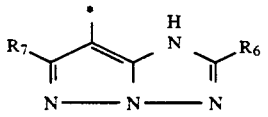

(If)

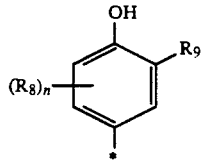

(Ig)

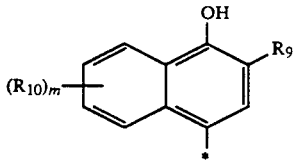

(Ih)

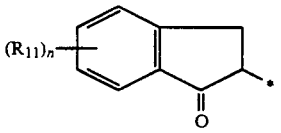

wherein $R_1$ represents an alkyl group, an aryl group or an arylamino group, $R_2$ represents an aryl group or an alkyl group, $R_3$ represents an alkyl group or an aryl group, $R_4$ represents an alkyl group, an acylamino group, an arylamino group, an arylureido group or an alkylureido group, $R_5$ represents an acylamino group, a sulfonamide group, an alkyl group, an alkoxy group or a halogen atom, $R_6$ represents an alkyl group or an aryl group, $R_7$ represents an alkyl group, an aryl group, an acylamino group, an arylamino group, an alkoxy group, an arylureido group or an alkylureido group, $R_8$ represents a halogen atom, an alkyl group, an alkoxy group, an acylamino group or a sulfonamide group, $R_9$ represents an acylamino group, a carbamoyl group or an arylureido group, $R_{10}$ represents an amino group, a substituted amino group, an amide group, a sulfonamide group or a hydroxyl group, $R_{11}$ represents a nitro group, an acylamino group, a succinimide group, a sulfonamide group, an alkoxy group, an alkyl group, a halogen atom or a cyano group, "*" represents a bonding position to —(Time)$_n$—, l in (Ic) represents an integer of 0 to 3, n in (If) and (Ih) 0 to 2, and m in (Ig) 0 or 1, respectively, when l and n are 2 or more, each $R_5$, $R_8$ and $R_{11}$ may be the same or different from each other.

3. The material of claim 1 wherein A is a group which cleaves —(Time)$_n$— through redox reaction with an oxidized product of a color developing agent selected from the group consisting of:

$$ED^1—* \quad \text{(IIa)}$$

$$ED^2—(L)_m—A_1—* \quad \text{(IIb)}$$

$$R—X—A_1—\underset{R_1}{NH}—N—\underset{*}{CH_2CH}—B \quad \text{(IIc)}$$

-continued (IId)

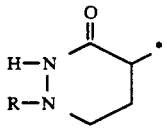

wherein $ED^1$ represents a redox mother nucleus obeying Kendall-Pelz Law, and can cleave —(Time)$_n$— by being oxidized by an oxidized product of a developing agent during photographic development processing, $ED^2$ represents a redox mother nucleus obeying Kendall-Pelz Law, $A_1$ represents an acidic group selected from the group consisting of $$-\overset{O}{\overset{\|}{C}}-,\ -\overset{S}{\overset{\|}{C}}-,\ -\overset{N-R_2}{\overset{\|}{C}}-,\ -SO-,\ -SO_2- \text{ and } -\overset{O}{\overset{\|}{\underset{OR}{\underset{|}{P}}}}-.$$

where R represents a substituted or unsubstituted alkyl group, a substituted or unsubstituted aryl group, or a substituted or unsubstituted heterocyclic group, $R_2$ represents a hydrogen atom or R, L represents a divalent linking group selected from alkylene, alkenylene, arylene, oxyalkylene, oxyarylene, aminoalkyleneoxy, aminoalkenyleneoxy, aminoaryleneoxy and an oxygen atom, m represents 0 or 1; B represents an acidic group selected from the group consisting of a nitro group, a cyano group, a carboxy group, a sulfo group or —$A_1$—X—R, where X represents a bonding arm, —C—, —S— or $$-\overset{R_2}{\overset{|}{N}}-,$$

A1 and R have the same meanings as defined above; $R_1$ represents a hydrogen atom, an alkyl group, an aryl group, an acyl group, a carbamoyl group, an oxycarbonyl group, a sulfonyl group, a sulfamoyl group, a heterocyclic group or $$-\underset{*}{\underset{|}{CH_2CH}}—B$$

and "*" represents a bonding position to —(Time)$_n$—.

4. The material of claim 3 wherein said $ED^1$ is a redox mother nucleus selected from the group consisting of hydroquinones, catechols, pyrogallols, aminophenols, naphthohydroquinones and aminonaphthols.

5. The material of claim 4 wherein said $ED^1$ is selected from the group consisting of hydroquinone, catechol, pyrogallol, p-aminophenol, o-aminophenol, 1,4-naphthalenediol and 1,4-aminonaphthol.

6. The material of claim 3 wherein said $ED^2$ is a redox mother nucleus selected from the group consisting of hydroquinones, catechols, pyrogallols, aminophenols, naphthohydroquinones, aminonaphthols, pyrazolidones, hydrazines, hydroxyamines and reductones.

7. The material of claim 1 wherein said FL portion is a compound residue selected from the group consisting of:

(IIIa)

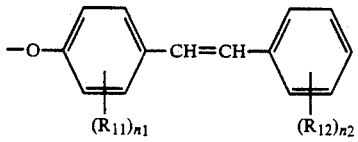

(IIIb)

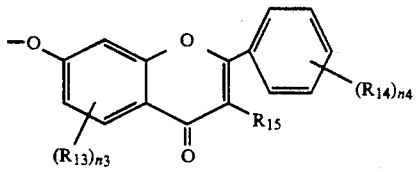

(IIIc)

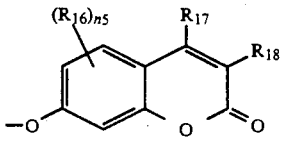

(IIId)

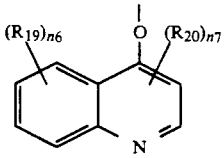

wherein $R_{11}$ to $R_{20}$ are substituents which do not lose fluorescence of the FL portion selected from the group consisting of a halogen atom, a nitro group, a cyano group, a sulfonamide group, a hydroxyl group, a carboxyl group, an alkyl group, an alkoxy group, a carbonyloxy group, an acylamino group, an aryl group, an amino group, a carbamoyl group and an oxycarbonyl group, $n_1$ represents an integer of 0 to 4, $n_2$ 0 to 5, $n_3$ 0 to 3, $n_4$ 0 to 5, $n_5$ 0 to 3, $n_6$ 0 to 3, and $n_7$ 0 to 2, respectively.

8. The material of claim 1 wherein the compound represented by the formula (I) is a compound selected from the group consisting of:

F-1

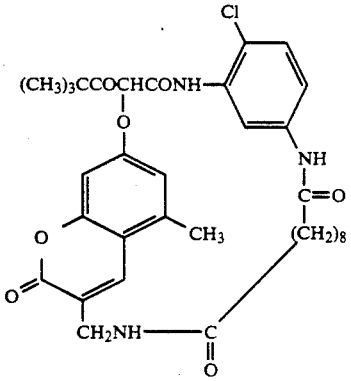

-continued

F-2

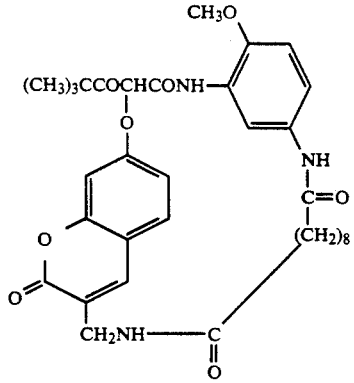

F-3

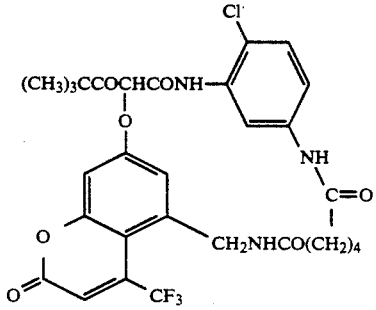

F-4

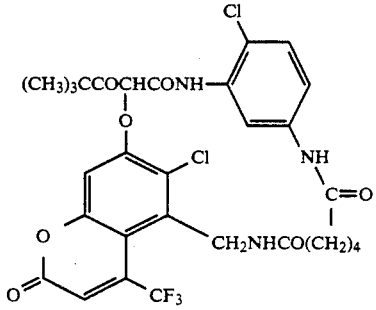

F-5

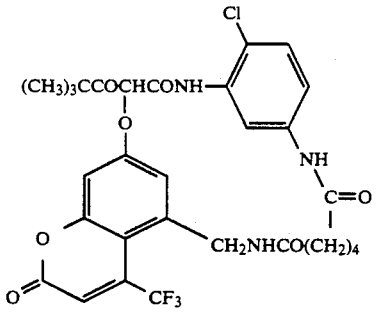

F-6

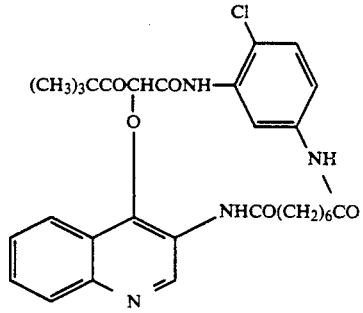

-continued

F-7

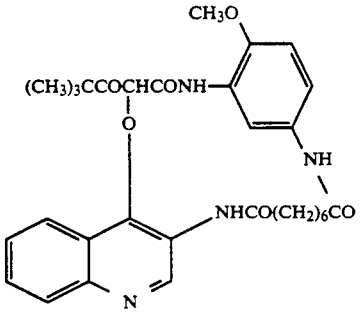

F-8

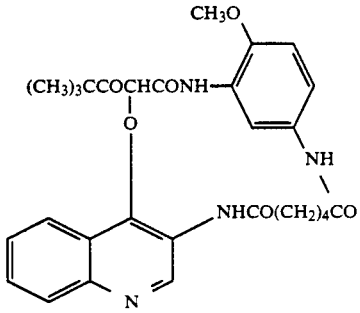

F-9

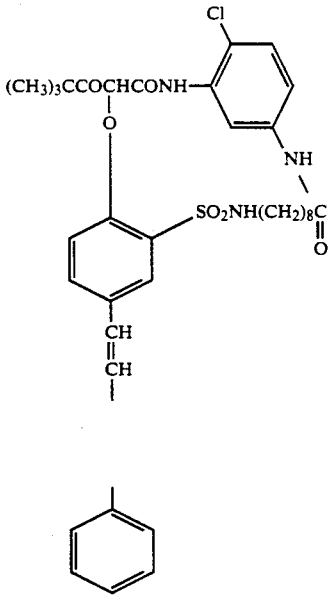

-continued

F-10

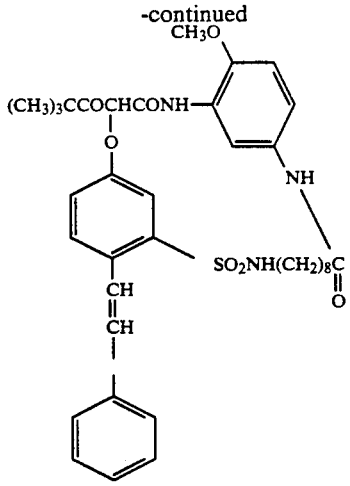

F-11

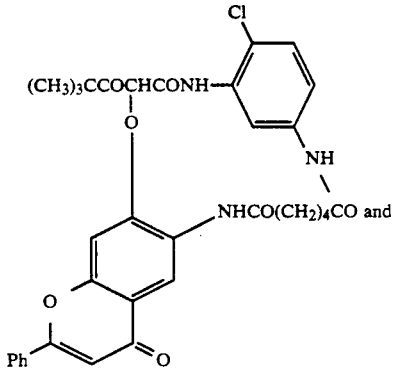

F-12

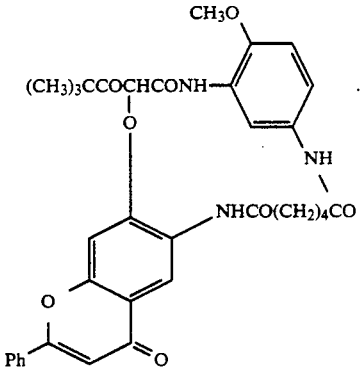

9. The material of claim 1 wherein a water-soluble dye represented by the following formula (A-1) is contained in at least one layer of the material:

(A-1)

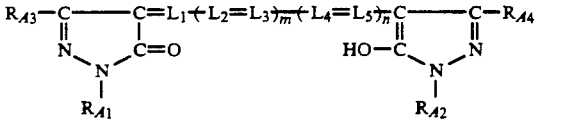

wherein $L_1$, $L_2$, $L_3$, $L_4$ and $L_5$ each represent a methine group, and m and n each represent 0 or 1;

$R_{A1}$ and $R_{A2}$ each represent a hydrogen atom, an alkyl group, an aralkyl group, an aryl group and a heterocyclic group; and $R_{A3}$ and $R_{A4}$ each represent an alkyl group, an aryl group, an aralkyl group, a heterocyclic group, a carboxy group, an alkoxycarbonyl group, an aryloxycarbonyl group, a carbamoyl group, a ureido group, a thioureido group, an acylamino group, an acyl group, an imide group, a cyano group, a hydroxy group, an alkoxy group and an amino group.

* * * * *

UNITED STATES PATENT AND TRADEMARK OFFICE

CERTIFICATE OF CORRECTION

PATENT NO. : 5,204,232
DATED : April 20, 1993
INVENTOR(S) : Hirokazu Sato et al.

It is certified that error appears in the above-indentified patent and that said Letters Patent is hereby corrected as shown below:

Claim 1, column 50, line 33, after "which" insert --, as a function of development,--.

Claim 1, column 50, line 34, after "which" insert --, as a function of development,--.

Claim 1, column 50, line 38, delete ", as a function of development,".

Claim 1, Column 50, line 40, delete ", as a function of development,".

UNITED STATES PATENT AND TRADEMARK OFFICE

CERTIFICATE OF CORRECTION

PATENT NO. : 5,204,232

DATED : April 20, 1993

INVENTOR(S) : Hirokazu Sato et al.

It is certified that error appears in the above-indentified patent and that said Letters Patent is hereby corrected as shown below:

Claim 8, columns 55 and 56, in Formulae 9 and 10, change " 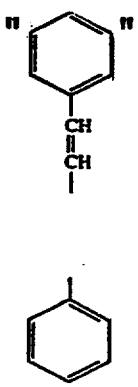 " to -- 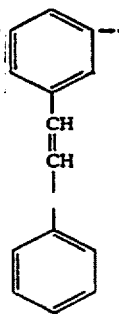 --.

Signed and Sealed this

Eighteenth Day of October, 1994

*Attest:*

*Attesting Officer*

BRUCE LEHMAN

*Commissioner of Patents and Trademarks*